US006225546B1

(12) United States Patent
Kraft et al.

(10) Patent No.: US 6,225,546 B1
(45) Date of Patent: May 1, 2001

(54) METHOD AND APPARATUS FOR MUSIC SUMMARIZATION AND CREATION OF AUDIO SUMMARIES

(75) Inventors: Reiner Kraft, Gilroy; Qi Lu, San Jose, both of CA (US); Shang-hua Teng, Champaign, IL (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/543,715

(22) Filed: Apr. 5, 2000

(51) Int. Cl.[7] ..... A63H 5/00; G04B 13/00; G10H 7/00

(52) U.S. Cl. ..... 84/609; 84/645; 700/94; 704/900

(58) Field of Search ..... 84/609, 634, 645; 700/94; 704/300, 503

(56) References Cited

U.S. PATENT DOCUMENTS

| | | | | |
|---|---|---|---|---|
| 5,179,718 | | 1/1993 | MacPhail . | |
| 5,286,908 | | 2/1994 | Jungleib . | |
| 5,467,288 | | 11/1995 | Fasciano et al. . | |
| 5,533,902 | | 7/1996 | Serra et al. . | |
| 5,536,903 | | 7/1996 | Kennedy . | |
| 5,553,002 | | 9/1996 | Dangelo et al. . | |
| 5,557,424 | | 9/1996 | Panizza . | |
| 5,574,915 | | 11/1996 | Lemon et al. . | |
| 5,585,583 | | 12/1996 | Owen . | |
| 5,604,100 | | 2/1997 | Perlin . | |
| 5,657,221 | | 8/1997 | Warman et al. . | |
| 5,715,318 | | 2/1998 | Hill et al. . | |
| 5,734,119 | | 3/1998 | France et al. . | |
| 5,736,633 | | 4/1998 | Aoki et al. . | |
| 5,736,663 | * | 4/1998 | Aoki et al. | 84/609 |
| 5,739,451 | * | 4/1998 | Winksy et al. | 84/609 |
| 5,757,386 | | 5/1998 | Celi, Jr. et al. . | |
| 5,787,413 | | 7/1998 | Kauffman et al. . | |
| 5,792,972 | | 8/1998 | Houston . | |
| 5,802,524 | | 9/1998 | Flowers et al. . | |
| 5,874,686 | * | 2/1999 | Ghias et al. | 84/609 |
| 5,952,597 | * | 9/1999 | Weinstock et al. | 84/609 |
| 5,952,598 | * | 9/1999 | Goede | 84/609 |
| 5,963,957 | * | 10/1999 | Hoffberg | 707/104 |
| 6,096,961 | * | 8/2000 | Bruti et al. | 84/609 |

FOREIGN PATENT DOCUMENTS

| | | |
|---|---|---|
| 061695 | 9/1997 | (JP) . |
| WO97/50076 | 12/1997 | (WO) . |
| WO98/01842 | 1/1998 | (WO) . |

OTHER PUBLICATIONS

"Dynamic Icon Presentation", IBM Technical Disclosure Bulletin, v. 35 n. 4B, pp. 227–232, Sep. 1992, IBM Corporation, Armonk, NY.

* cited by examiner

*Primary Examiner*—Jeffrey Donels
(74) *Attorney, Agent, or Firm*—Kudirka & Jobse, LLP

(57) ABSTRACT

A method and system for generating audio summaries of musical pieces receives computer readable data representing the musical piece and generates therefrom an audio summary including the main melody of the musical piece. A component builder generates a plurality of composite and primitive components representing the structural elements of the musical piece and creates a hierarchical representation of the components. The most primitive components, representing notes within the composition, are examined to determine repetitive patterns within the composite components. A melody detector examines the hierarchical representation of the components and uses algorithms to detect which of the repetitive patterns is the main melody of the composition. Once the main melody is detected, the segment of the musical data containing the main melody is provided in one or more formats. Musical knowledge rules representing specific genres of musical styles may be used to assist the component builder and melody detector in determining which primitive component patterns are the most likely candidates for the main melody.

30 Claims, 5 Drawing Sheets

METHOD AND APPARATUS FOR MUSIC SUMMARIZATION AND CREATION OF AUDIO SUMMARIES

RELATED APPLICATIONS

This application is one of four related applications filed on an even date herewith and commonly assigned, the subject matters of which are incorporated herein by reference for all purposes, including the following:

U.S. patent application Ser. No. 09/543,11, entitled "Method and Apparatus for Updating a Design by Dynamically Querying Querying an Information Source to Retrieve Related Information";

U.S. patent application Ser. No. 09/543,230, entitled "Method and Apparatus for Determining the Similarity of Complex Designs"; and U.S. patent application Ser. No. 09/543,218, entitled "Graphical User Interface to Query Music by Examples".

FIELD OF THE INVENTION

This invention relates generally to data analysis, and, more specifically to a techniques for summarizing audio data and for generating an audio summary useful to a user.

BACKGROUND OF THE INVENTION

An important problem in large-scale information organization and processing is the generation of a much smaller document that best summarizes an original digital document. For example, a movie clip may provide a good preview of the movie. A book review describes a book in a short and concise fashion. An abstract of a paper provides the main results of the paper without giving out the details. A biography tells the life story of a person without recording every single events of his/her life. The summarization as mentioned above are often carefully produced from the original document manually. However, in the era where a large volume of documents are made publicly available on mediums such as the Internet, the problem of automatic summarization has become increasingly important.

There are vast differences in techniques for summarizing documents of different types and content. For example, sampling and coarsening can be applied to digital images. One approach to generate a smaller but similar image from an original digital image is to keep every kth pixel in the image, and hence reduce an n by n image to an n/k by n/k image. Some smoothing operations can be applied to the smaller image to make the coarsened image more visually pleasing. Another approach is to apply an image compression technique, such as JPAG and MTAG, where the coefficients of less significant basis components are eliminated.

In contrast, text-document summarization is much harder to automate. A compressed text file is often unreadable. Various heuristics techniques have been developed. For example, Microsoft Word software examines frequently-used terms in a document and picks sentences that may be close to the main theme, however, the summarization so produced is not quite appealing.

Although numerous compression techniques exist for compressing audio data, these techniques, as well as the summarization techniques described above for graphic and/or text information, are not applicable to the summarization of musical compositions. Because of the highly sophisticated structure and sequence of a musical composition and the aspects of the compositions which are recognizable to the listener, the task of efficiently summarizing a musical composition presents a number of difficult challenges which have yet to be addressed in the prior art. Accordingly, a need exists for a way in which musical compositions in a variety of formats and/or styles may be summarized to create a brief summary of the common theme of the composition so as to be readily recognized by a listener.

A further need exists for a method and technique in which the structure and aspects of a musical composition may be broken down into the primitive components of the musical composition and repetitive patterns detected and a summarization generated from the patterns.

SUMMARY OF THE INVENTION

This invention discloses a summarization system for music compositions which automatically analyzes a piece of music given in audio-format, MIDI data format, or the original score, and generates a hierarchical structure that summarizes the composition. The summarization data is then used to create an audio segment (thumbnail) which is useful in recognition of the musical piece. A key aspect of the invention is to use the structure information of the music piece to determine the main melody and use the main melody or a part thereof as the representative audio summary.

The inventive system utilizes the repetition nature of music compositions to automatically recognize the main melody theme segment of a given piece of music. In most music compositions, the melody repeats itself multiple number times in various close variations. A detection engine utilizes algorithms that model melody recognition and music summarization problems as various string processing problems and efficiently processes the problems. The inventive technique recognizes maximal length segments that have non-trivial repetitions in each track of the Musical Instrument Design Interface (MIDI) format of the musical piece. These segments are basic units of a music composition, and are the candidates for the melody in a music piece. The system then applies domain-specific music knowledge and rules to recognize the melody among other musical parts to build a hierarchical structure that summarizes a composition.

According to the invention, a method and system for generating audio summaries of musical pieces receives computer readable data representing the musical piece and generates therefrom an audio summary including the main melody of the musical piece. A component builder generates a plurality of composite and primitive components representing the structural elements of the musical piece and creates a hierarchical representation of the components. The most primitive components, representing notes within the composition, are examined to determine repetitive patterns within the composite components. A melody detector examines the hierarchical representation of the components and uses algorithms to detect which of the repetitive patterns is the main melody of the composition. Once the main melody is detected, the segment of the musical data containing the main melody is provided in one or more formats. Musical knowledge rules representing specific genres of musical styles may be used to assist the component builder and melody detector in determining which primitive component patterns are the most likely candidates for the main melody.

According to one aspect of the present invention, a method of generating an audio summarization of a musical piece having a main melody, the method comprising: receiving computer-readable data representing the musical piece; generating from the computer-readable data a plurality of components representing structural elements of the musical piece; detecting the main melody among the generated components; and generating an audio summary containing a representation of the detected main melody.

According to a second aspect of the invention, an apparatus for generating an audio summarization of a musical piece having a main melody comprises: an analyzer configured to receive computer-readable data representing the musical piece; a component builder configured to generate from the computer-readable data a plurality of components representing structural elements of the musical piece; a detection engine configured to detect the main melody among the generated components; and a generator configured to create an audio summary containing a representation of the detected main melody.

According to a third aspect of the invention, a computer program product for use with a computer apparatus comprises: analyzer program code configured to receive computer-readable data representing the musical piece; component builder program code configured to generate from the computer-readable data a plurality of components representing structural elements of the musical piece; detection engine program code configured to detect the main melody among the generated components; and generator program code configured to create an audio summary containing a representation of the detected main melody.

BRIEF DESCRIPTION OF THE DRAWINGS

The above and other features, objects and advantages of the invention will be better understood by referring to the following detailed description in conjunction with the accompanying drawing in which.

DETAILED DESCRIPTION

Figure 1:
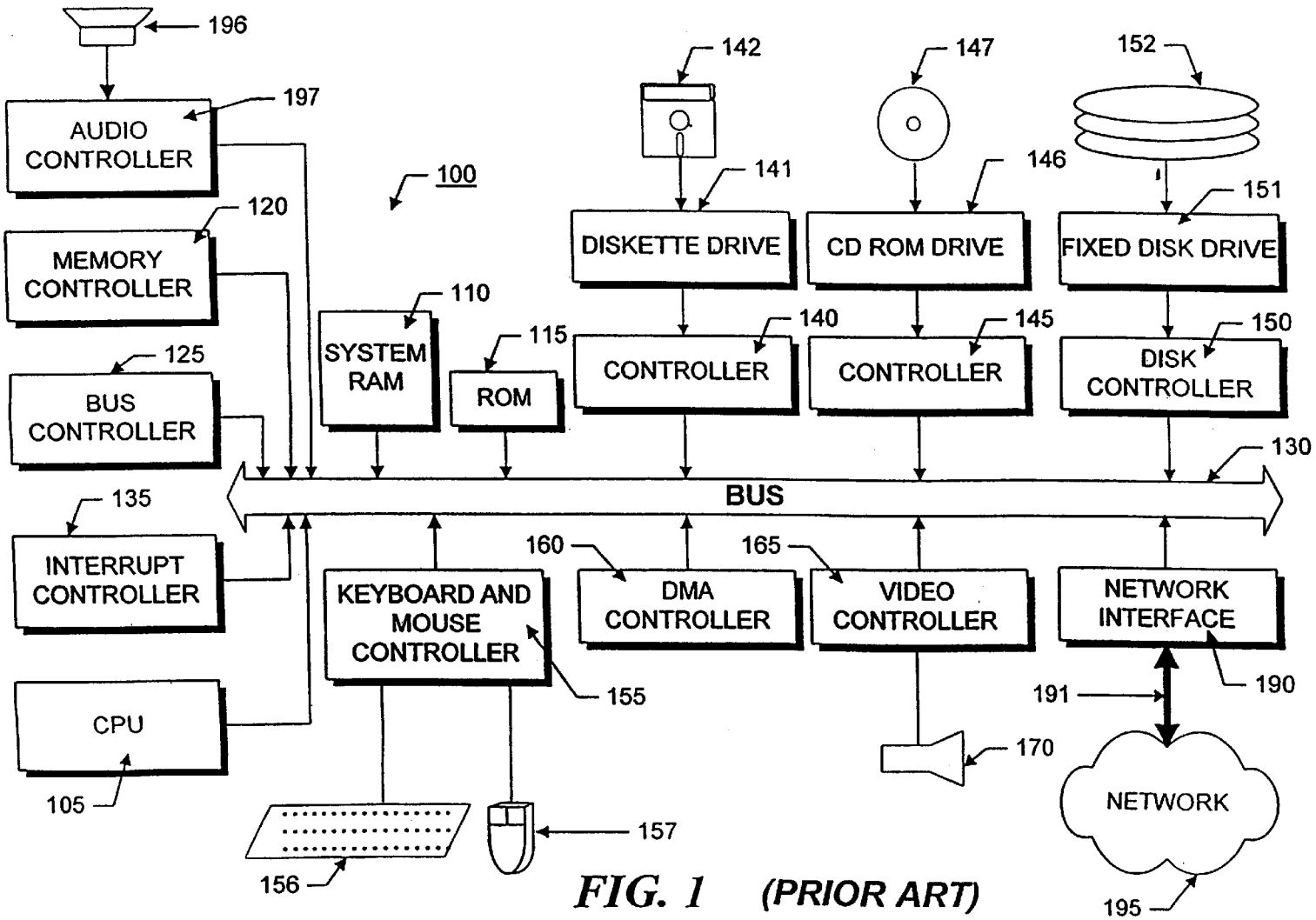
FIG. 1 (PRIOR ART)
FIG. 1 is a block diagram of a computer system suitable for use with the present invention.

FIG. 1 illustrates the system architecture for a computer system 100 such as an IBM Aptiva Personal Computer (PC), on which the invention may be implemented. The exemplary computer system of FIG. 1 is for descriptive purposes only. Although the description may refer to terms commonly used in describing particular computer systems, the description and concepts equally apply to other systems, including systems having architectures dissimilar to FIG. 1.

Computer system 100 includes a central processing unit (CPU) 105, which may be implemented with a conventional microprocessor, a random access memory (RAM) 110 for temporary storage of information, and a read only memory (ROM) 115 for permanent storage of information. A memory controller 120 is provided for controlling RAM 110.

A bus 130 interconnects the components of computer system 100. A bus controller 125 is provided for controlling bus 130. An interrupt controller 135 is used for receiving and processing various interrupt signals from the system components.

Mass storage may be provided by diskette 142, CD ROM 147, or hard drive 152. Data and software may be exchanged with computer system 100 via removable media such as diskette 142 and CD ROM 147. Diskette 142 is insertable into diskette drive 141 which is, in turn, connected to bus 30 by a controller 140. Similarly, CD ROM 147 is insertable into CD ROM drive 146 which is, in turn, connected to bus 130 by controller 145. Hard disk 152 is part of a fixed disk drive 151 which is connected to bus 130 by controller 150.

User input to computer system 100 may be provided by a number of devices. For example, a keyboard 156 and mouse 157 are connected to bus 130 by controller 155. An audio transducer 196, which may act as both a microphone and a speaker, is connected to bus 130 by audio controller 197, as illustrated. It will be obvious to those reasonably skilled in the art that other input devices, such as a pen and/or tabloid may be connected to bus 130 and an appropriate controller and software, as required. DMA controller 160 is provided for performing direct memory access to RAM 110. A visual Ao display is generated by video controller 165 which controls video display 170. Computer system 100 also includes a communications adapter 190 which allows the system to be interconnected to a local area network (LAN) or a wide area network (WAN), schematically illustrated by bus 191 and network 195.

Operation of computer system 100 is generally controlled and coordinated by operating system software, such as the OS/2® operating system, commercially available from International Business Machines Corporation, Boca Raton, Fla., or Windows NT®, commercially available from MicroSoft Corp., Redmond, Wash. The operating system controls allocation of system resources and performs tasks such as processing scheduling, memory management, networking, and I/O services, among things. In particular, an operating system resident in system memory and running on CPU 105 coordinates the operation of the other elements of computer system 100. The present invention may be implemented with any number of commercially available operating systems including OS/2, UNIX, DOS, and WINDOWS, among others. One or more applications such as Lotus NOTES, commercially available from Lotus Development Corp., Cambridge, Mass. may execute under the control of the operating system. If the operating system 200 is a true multitasking operating system, such as OS/2, multiple applications may execute simultaneously.

Figure 2:
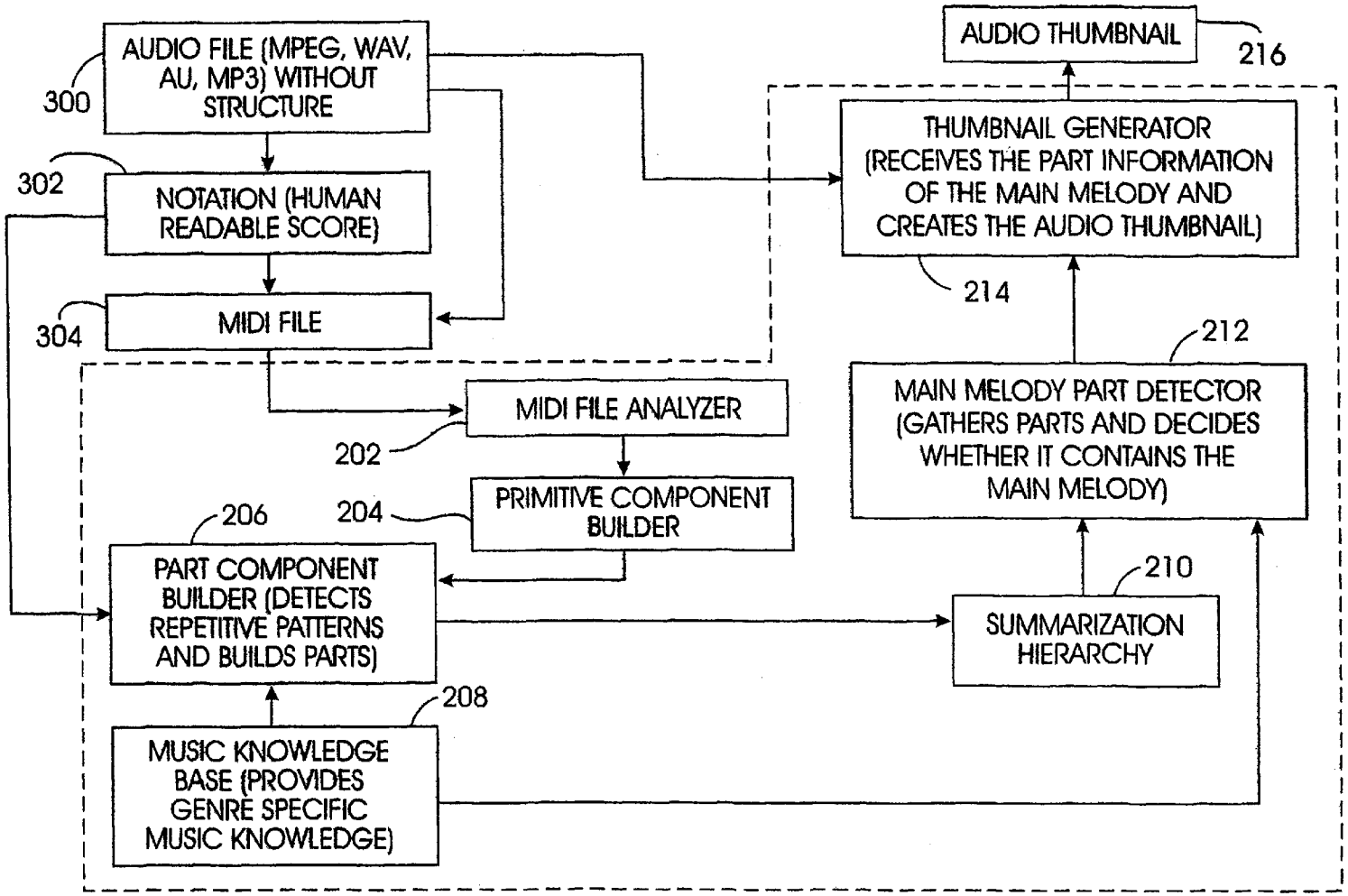
FIG. 2 is a conceptual block diagram illustrating the components of the inventive system used for generation of an audio summary in accordance with the present invention.

FIG. 2 illustrates conceptually the main components of a system 200 in accordance with the present invention, along with various input and output files. Specifically, system 200 comprises a MIDI file analyzer 202, a primitive component builder 204, a part component builder 206, a music knowledge base 208, a melody detection engine 212 and an audio summary generator 214. In addition, FIG. 2 also illustrates the result end product of system 200, the audio thumbnail file 216, the input data to system 200, namely, audio file 300, score 302 and MIDI file 304, and the interim data structure used by a melody detection engine 212, i. e. summarization hierarchy 210.

The individual constructions and functions of the components of system 200 are described hereinafter in the order in which they participate in the overall music summarization method or process. Generally, system 200 may be implemented as an So all software application which executes on a computer architecture, either a personal computer or a server, similar to that described with reference to FIG. 1. In addition, system 200 may have a user interface component (not shown) which is described in greater detail with reference to the previously-referenced co-pending applications. In the illustrative embodiment, the music summarization system 200 may be implemented using object-oriented technology or other programming techniques, at the designer's discretion.

Figure 3:
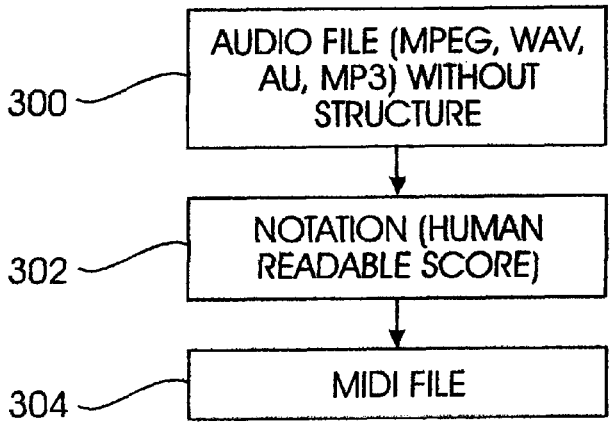
FIG. 3 is a conceptual block diagram of the processes for converting a file of audio data into a computer usable file.

A first step in the inventive process is to convert a musical composition or song into a computer interpretable format such as the Musical Instrument Digital Interface (MIDI). FIG. 3 illustrates the different formats and conversion steps in which an audio file 300 may be converted into a computer interpretable format, such as the MIDI format. Specifically, as illustrated in FIG. 3, an audio file 300 may be in the format of an MPEG, .WAV, .AU, or .MP3 format. Such formats provide data useful only in generating an audio signal representative of the composition and are devoid of any structural information which contributes to the overall sound of the audio wave. Such files may be converted either directly to a MIDI file 304, or, into an intermediate musical notation format 302, such as a human readable score 302. Specifically, systems exist for automatic transcription of acoustic signals. Although such systems usually do not work in real time, they are useful in generating a human readable notation format 302. Once in human readable notation form, standard Object Character Recognition techniques known in the arts can be used to generate a MIDI file based on the notation format 302. The today's existing MIDI sequencer and composer software, such as those commercially available from CakeWalk, Cambridge, Mass., or Cubase, commercially available from Steinberg, Inc. of Germany are also able to generate a human readable notation, if necessary. Note that use of MIDI data as a basis to generate the structural information of a musical piece is preferred rather then the scored notation format, since MIDI data is already in a computer readable format containing primitive structure information useful to the inventive system described herein.

Next, system 200 parses the song data and generates the missing structural information. First, MIDI file analyzer 202 analyzes the MIDI data file 304 to arrange the data in standard track-by-track format. Next, primitive component builder 204 parses the MIDI file into MIDI primitive data, such as note on and note off data, note frequency (pitch) data, time stamp data associated with note on and note off events, time meter signature, etc. The structure and function of such a parser being within the scope of those skilled in the arts given the output generated by the file analyzer 202. Alternatively, the functions of module 202 and 204 may be implemented with a commercial MIDI sequencing and editing software, such as Cakewalk, commercially available from CakeWalk, Cambridge, Mass., or Cubase, commercially available from Steinberg, Inc. of Germany.

Figure 4:
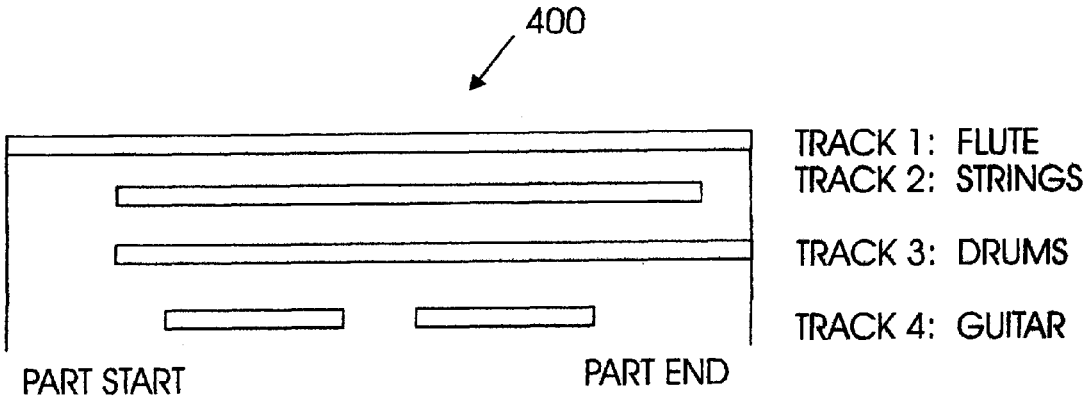
FIG. 4 is a conceptual diagram of a MIDI file illustrating the various parts of a musical composition as a plurality of tracks.

Next, part component builder 206 generates parts from the parsed MIDI data primitives by detecting repetitive patterns within the MIDI data primitives and building parts therefrom. In an alternative embodiment of the present invention, part component builder 206 may also generate parts from a human readable score notation such as that of file 302. As shown in FIG. 4, a MIDI file 400 is essentially a collection of one or more layered tracks 402–408. Typically, every track represents a different instrument e.g. Flute, Strings, Drums, Guitar etc. However, sometimes one track contains multiple instruments. As illustrated, tracks do not need to start and end at the same time. Each can have a separate start and end position. Also, a track can be repeated multiple times. The information on how tracks are arranged is stored in a Part component generated by part component builder 206.

The part component builder 206 comprises program code which performs the algorithms set forth hereafter, given the output from primitive component builder 204 in order to detect repetitive patterns and build the summarization hierarchy. To better understand the process by which part component builder 206 generates a summarization hierarchy of a song, the components which comprise the song and the hierarchical structure of these components are described briefly hereafter.

Summarization Hierarchy

In accordance with the present invention, a song or musical piece, referred to hereafter as a composite component (c-components), consists typically of the following components:

Song
Parts
Tracks
Measures
Notes

Notes are primitive components (p-components), i.e. atomic level data, that do not contain sub-components. Tracks, Parts, Measures and Song are composite components (c-components) and may contain sequence information, for example in form of an interconnection diagram (i-Diagram).

All components are allowed to have attributes. Attributes identify the behavior, properties and characteristic of a component and can be used to perform a similarity check. Attributes are distinguished between fixed attributes and optional attributes. Fixed attributes are required and contain basic information about a component. For instance one of a measure's fixed attribute is its speed, i.e. beats per minute. Optional attributes however could be additional information the user might want to provide, such as genre, characteristic or other useful information. The data structure of additional information is not limited to attribute value pairs. In order to provide a hierarchy use is made of Extended Markup Language (XML) and provide a document type definition (DTD) for each components optional attribute list. In the illustrative embodiment, note that p-components are not allowed to have optional attributes.

Components can be connected by forming a hierarchical structure. Therefore a simple grammar, for example in BNF form, can be used to describe the hierarchical structure, as illustrated below:

SONG :: =Part+
Part :: =Track+
Track :: =Measure+
Measure :: =Note+

The MIDI file 304 consists of enough information, i.e. notes, measures and tracks from which to build a component tree using a bottom-up approach with Track as its top component. Given a set of tracks, algorithms described hereafter within part component builder 206 use these Track components to search for repetitive patterns, and with such information constructs the Part components using a bottom-up approach. Melody detector 212 using the algorithms described hereafter and the summarization hierarchy generated by within part component builder 206 detects the Part component which contains the main melody.

To facilitate an understanding of Note components and their attributes, some basic music theory concepts are introduced for the reader's benefit. In western "well-tempered"

instruments e.g. piano, guitar, etc. there are twelve distinct pitches or notes in an octave. These notes build the chromatic scale (starting from C):

| C | #C | D | #D | E | F | #F | G | #G | A | #A | B | C |
|---|---|---|---|---|---|---|---|---|---|---|---|---|
| 1 | 2 | 3 | 4 | 5 | 6 | 7 | 8 | 9 | 10 | 11 | 12 | 1 |

Notes are designated with the first seven letters of the Latin alphabet:

a b c d e f g and symbols for chromatic alternations:: # (sharp) and b (flat). The distance between two succeeding notes is a half-tone (H). Two half-tones build a whole-tone (W).

Without the sharped notes, there are seven natural notes. Starting from c they build the C major scale:

| C | | D | | E | | F | | G | | A | | B | | C |
|---|---|---|---|---|---|---|---|---|---|---|---|---|---|---|
| 1 | | 2 | | 3 | | 4 | | 5 | | 6 | | 7 | | |
| | W | | W | | H | | W | | W | | W | | H | |

These notes build a diatonic scale. A diatonic scale consists of seven natural notes, arranged so that they build five whole-tones and two half-tones. The first and the last note of a diatonic scale is called tonic. The seventh tone is called leading tone because it leads to the tonic.

There are two types of accidentals. The sharp and the flat. The sharp (#) raises the tone of the note by a half-tone. The sharp produces seven sharped notes: (#C, #D, #E, . . . ). Because #e is the same note as f and #b is the same note as c, only five notes are new. The flat (b noted here as !) lowers the tone of the note by a half-tone and produces seven flatted notes: (!c, !d, !e, . . . ). Again because !c is the same note as b and !f is the same note as e only five notes are new. These notes are the same produced by sharped notes, i.e. #c through !d and #d through !e, etc. The chromatic scale consists of all twelve notes, seven diatonic notes and five flatted or sharped notes.

One of the algorithms used by part component builder 206 to detect a part in the MIDI data is the identification of repeating segments. A piece of music consists of a sequence of parts. The main melody, or main theme segment often repeats itself in the composition. In many musical styles, the main melody has the highest number of repetitions. There are exceptions to this rule. Depending on the genre of the music there are different rules of how to identify the Part which contains the main melody.

Usually, each repetition of the main melody comes with a small variation, also depending on the genre. The most important step in building the summarization hierarchy is to automatically recognize the Part which contains the main melody and all its occurrences.

Variation Issues

Each repetition of the main melody comes usually with variations. Although these Parts have variations, they are treated equally in terms of the music summarization context. For example music composer are often using different techniques of variations to make the song more interesting. Some of these techniques can be detected in order to automatically compare two parts to find out whether there are equal. These techniques differ depending on the music genre the song belongs to. For instance, in most of today's pop- and rock compositions the main melody part repeats typically in the same way without major variations. However, a jazz composition usually comprises the improvisation of the musicians, producing variations in most of the parts and creating problems in determining the main melody part.

The present invention utilizes beat and notes components to detect variations on the primitive components, e.g., the notes. A first technique, utilized by part component builder 206 is to recognize variation based the duration of notes. Notes are primitive components and belong to a measure. One of their attributes is duration. Duration is measured using a tuple expression (e.g. ¼, ½, etc.). The sum of the duration of all notes in one measure together is determined by the measure's attribute size. Size is also measured using a tuple expression (e.g. 4/4, ¾, etc.). Given a rhythmic meter of 4/4, meaning each metered segment of the composition includes four beats with each beat being defined with a quarter note, the beat size is ¼, i.e., one quarter of the duration of the measure. Accordingly, each beat may contain any combination of notes which collectively comprise ¼ of the total duration of the measure, for example, one quarter note, two eighth notes, four sixteenth notes, eight thirty-second notes, etc.

Variations based on the duration of notes are used in many musical styles. To detect this variation, the inventive algorithm checks a particular measure $_n$ and also uses the sequence information in the track to consider measure $_{n-1}$ and measure $_{n+1}$, because notes can overlap. For instance a note with a length of ½ could start on the third beat in a measure of size 4/4. In this case the note would not fully fit into this measure and therefore would continue in the following measure.

Variation Based on the Pitch of Notes

Changing the pitch, i.e. the highness or lowness, of a note creates what a listener perceives as a melody. To detect variation in pitch, a particular measure n, as well as sequence information in the track from measure $_{n-1}$ and measure $_{n+1}$, must be checked since a note of a constant pitch can overlap measures. For instance a note with a length of ½ could start at position ¾ in a beat of size 4/4. In this case the note would not fully fit into this beat and therefore would continue in the following beat.

In MIDI the standard, the pitch or frequency of a note is defined as an integer value from 0 to 127. A pitch shift of one octave would be +/− an integer value of 12. There are many various possibilities as long as the shift of the note follows the music genre's harmony pattern. These patterns describe how a sequence of notes can be constructed by following general harmonic rules of the musical genre.

Music knowledge database 208, in the illustrative embodiment, contains a rule base for a plurality of different musical styles. Each musical style such as classical, jazz, pop has a set of rules which define the melodic and harmonic interval theories within the style and can be used in conjunction with part component builder 206, and melody detector engine 212 to assist in the detection of a main melody within the components of a MIDI data file. The construction and function of such a music knowledge database is within the scope of those skilled in the arts and will not be described future herein for the sake of brevity. Generally, the more strict the rules defining the musical style, the easier the main melody may be detected. For example, certain styles such counterpoint from the baroque era of western music have very specific rules regarding melodic invention. By applying the knowledge of harmony and music theory, variations may be detected.

Variation Based on Shifting a Notes Position

In most music pieces, the melody and other parts repeat with some variations. The simplest type of variations of a segment is a shift. In practice, more general variational patterns are used. The chance that there are variations based on shifting the position of notes is likely at the end of a part (in the last beat). Variations based on shifting the position of notes could also happen somewhere in the middle of the part. To detect variation in shifting, a particular measure $_n$, as well as sequence information in the track from measure $_{n-1}$ and measure $_{n+1}$, must be checked since notes can overlap. For instance a note with a duration of ½ could start at beat 3 in a measure of size 4/4. In this case the note would not fully fit into this beat and therefore would continue in the following beat.

All the variations describes above can happen together, making it more difficult to detect these variations. In the illustrative embodiment, an algorithm first determines whether there are variations of length of notes. Next, an algorithm determines whether there are variations of pitch of the notes. By applying the knowledge of harmony patterns most of the variations should be possible to detect.

Genre Specific Considerations

Depending on the genre the music belongs to there are some additional considerations. Most of today's Rock and Pop music follows a similar scheme, for example ABAB format where A represents a verse and B represents a refrain. Music belonging to different genres (e.g. classical music, jazz, etc.) follows different format schemes.

The format scheme is important during the process of building the component hierarchy as performed by hierarchy engine 210. By applying the genre specific knowledge the music summarization process can produce better results. For example, a typical pop song may have the following form:

| | | | | | | | | | |
|---|---|---|---|---|---|---|---|---|---|
| Intro | Verse 1 | Bridge | Re-frain | Verse 2 | Bridge | Re-frain | Solo | Re-frain | Re-frain |

The main theme (Refrain) part occurs the most, followed by the Verse, Bridge and so on.

The structure of a song belonging to the Jazz genre may have the following form:

| | | | | | | | |
|---|---|---|---|---|---|---|---|
| Intro | Verse | Verse | Verse | Verse | Verse | Verse | End |

With the jazz composition there is no refrain. The main part is the verse which is difficult detect because of the improvisation of the musicians.

To detect a part by applying string repetition algorithms to only one track it's not enough to do a sophisticated summarization. As mentioned earlier, a Part component comprises one or more of tracks. After a successful summarization of one track, summarization of the other tracks is performed to confirm the summarized result. For example, after summarization of one track a candidate for the main part is detected. Similar summarization results of the other tracks will confirm or refute the detected candidate.

Another indicator for the main theme is the amount of tracks being used in this part. Usually a composer tries to emphasize the main theme of a song by adding additional instrumental tracks. This knowledge is particularly helpful if two candidates for the main theme are detected.

The music knowledge base 208 utilizes a style indicator data field defined by the user, or stored in the header of files 300, 302, or 304. The style indicator data field designates which set of knowledge rules on musical theory, such as jazz, classical, pop, etc., are to be utilized to assist the part component builder 206 in creating the summarization hierarchy 210. The codification of the music theory according to specific genres into specific knowledge rules useful by both part component builder 206 and melody detector engine 212 is within the scope of those reasonably skilled in the arts in light of the disclosures set forth herein.

Figure 5:
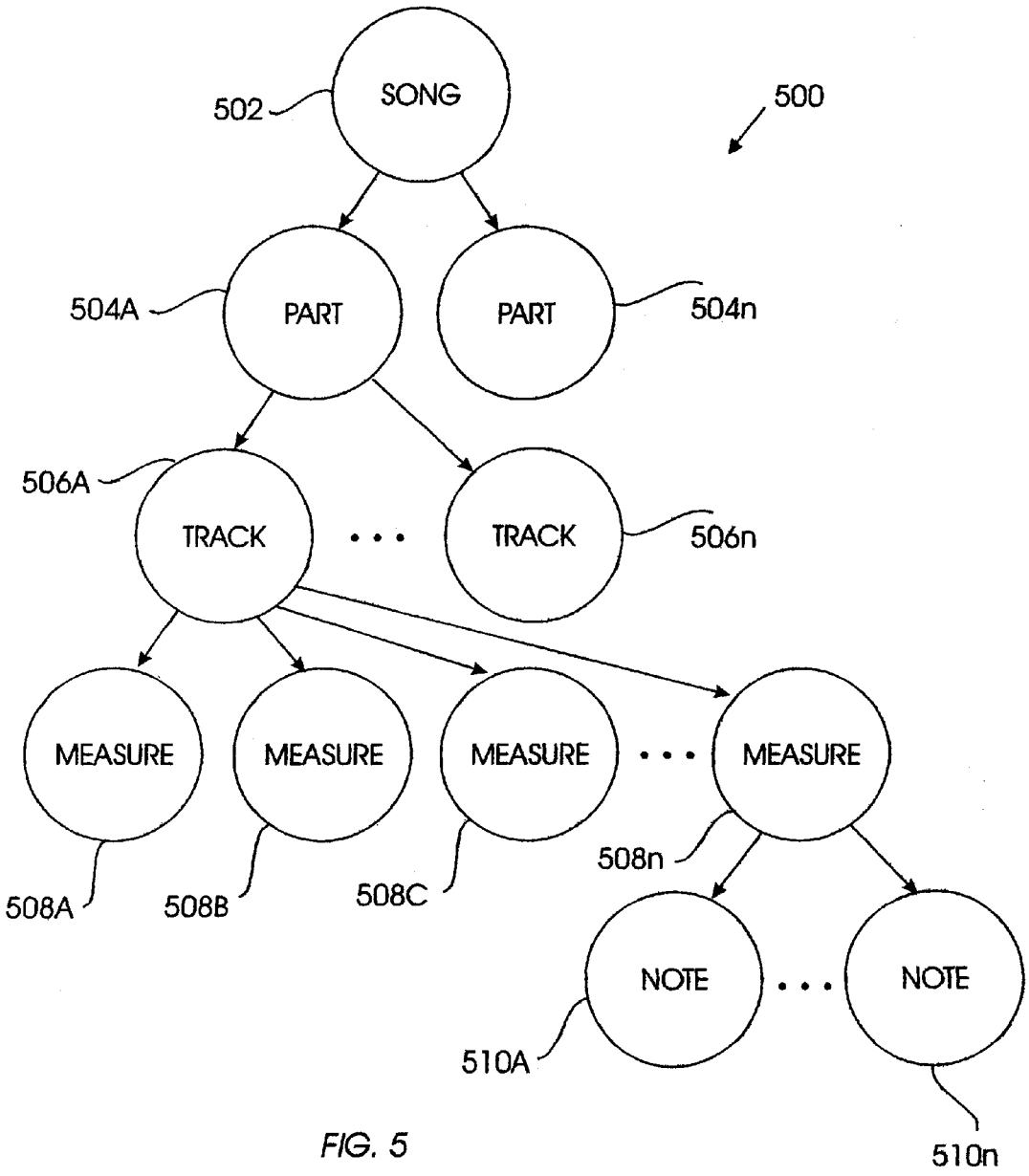
FIG. 5 is a conceptual diagram of a summarization hierarchy illustrating the various components of a musical composition as analyzed by the present invention and FIG. 6 is a flowchart illustrating the process steps utilized by the audio summarization engine of the present invention to generate audio summaries.
Figure 6:
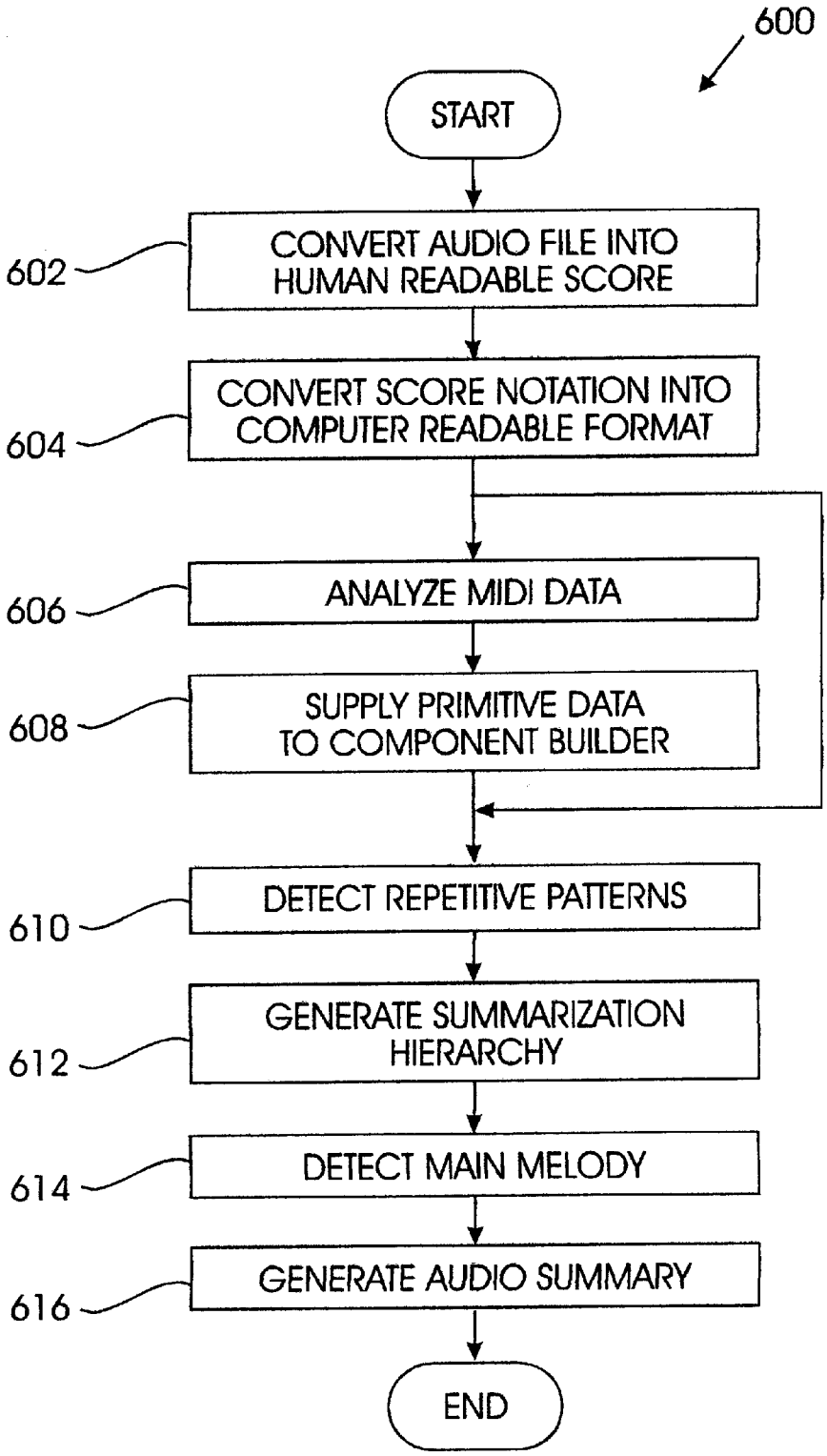

FIG. 5 illustrates a summarization hierarchy 210 as generated by part component builder 206. The summarization hierarchy 500 is essentially a tree of c-components having at its top a Song component 502, the branches from which include one or more Part components 504A–*n*. Parts 504A–*n* can be arranged sequentially to form the Song. Each Part component 504A–*n*, in turn, further comprises a number of Track components 506A–*n*, as indicated in FIG. 6. Each Track component 508A–*n*, in turn, comprises a number of Measures components 508A–*n*. Each Measure component 508A–*n*, in turn, comprises a number of Note components 510A–*n*. The summarization hierarchy 210 output from part component builder 206 is supplied as input into melody detector 212.

Melody Detector Engine

The identification of all occurrences of the main melody decomposes the music piece in a collection of parts. Each part itself is typically composed in a layer of tracks, which are typically composed in a sequence of measures. Once the main melody Part, and the other Parts are recognized, a summary of the hierarchical structure of the music piece, can be generated.

Once the melody and other parts of a track are recognized, hierarchical structure of the music piece can be generated. For the discussion of this description, it is assumed that the track is given as the music score, which can be viewed as a string where notes are alphabet characters and the duration of a note is regarded as a repetition of a note. For example, if ⅛ is the smallest step of duration, then ½ of "5" can be expressed as "5555". Such a technique can be used to transform a musical score, into a string of notes.

The melody detector engine 212 comprises program code which performs the following algorithms, given the summarization hierarchy 210, in order to detect the main melody of a musical piece.

Maximal Non-overlapping Occurrences

Let A be a finite alphabet and t be a finite length string over A. A string s over A has k non-overlapping occurrences in t if t can be written as $a_1 s a_2 s\ s a_k s a_{k+1}$. A string s is maximal with k non-overlapping occurrences if no superstring of s has k non-overlapping occurrences. The longest non-overlapping occurrence problem is to, given a string t and a positive integer k, find a sub-string s with the longest possible length that has k non-overlapping occurrences in t. Another closely related problem is: Given a string t, return all maximal sub-strings that have multiple (more than 1) non-overlapping occurrences in t, and a list of indices of the starting position of each occurrences.

Each string can have potentially an order of $n^2$ different sub-strings. As explained hereafter, only linear number of sub-strings are maximal sub-strings with multiple non-overlapping occurrences. A set of query problems are defined which can be useful for string (music) sampling: given t, build an efficient structure to answer So queries of types:

given a positive integer k, return one of the longest sub-strings with k non-overlapping occurrences in t;

given a positive integer k, return all longest sub-strings with k occurrence in t.

Algorithms for the Non-overlapping Re-occurrences Problem

Given a string t and a positive integer k, there are several methods for finding the maximum length sub-string that has k non-overlapping occurrences. A simple method enumerates all $n^2$ potential sub-strings and computes the number of their non-overlapping occurrences. This algorithm solves the non-overlapping re-occurrences problem in $n^3$ time. The solution to the non-overlapping re-occurrences problem can be used to answer the longest non-overlapping occurrence problem in linear time.

Advanced data structures such as suffix trees can be used to improve the complexity of the algorithm. Given a string t, the suffix tree of t can be defined as the following: If the length of t is n, then t has n suffixes including itself. Let \$ be a character that is not in the alphabet. Then the string t\$ has n+1 suffixes, $s_0, \ldots, S_n$, where $s_0$=t, and for each j, $s_j$ is a suffix of $s_{j-1}$ by deleting the first character of $s_j$. To define the suffix-tree, first grow a path for so from a starting node called the root. The jth edge of the path is labeled with the jth character of so. Then insert $S_1, \ldots, S_n$ starting from the root by following a path in the current tree (initially a path) if the characters of $s_j$ matches with the characters of the path, and branch once the first non-match is discovered. But doing so, a tree whose edges are labeled with characters is obtained. Each suffix is associated with a leaf of the tree in the sense that the string generated by going down from the root to the leaf yields the suffix. By contracting all degree two nodes of the tree and concatenate the characters of the contracted edges, one can obtain a tree where each internal node has at least two children. The resulting tree is the suffix-tree for t. The suffix-tree according to the procedure above takes $O(n^2)$ time to build). By exploring the common sub-strings, a suffix tree can be constructed in linear time. A suffix-trees is used to prove that there are only linear number of maximal So sub-strings with multiple non-overlapping occurrences.

Shifted Repetition

Suppose the characters of alphabet A are linearly ordered, say $A=\{s_0, \ldots, s_{m-1}\}$. Assuming that index-arithmetic addition and subtraction are mod m, i.e., (m−1)+1=0, extend the addition of indexes to letters by writing $a_i+j=a_{(i+j)}$ Let s be a string of length I, the jth shift of s, denoted by s+j, is a string where every letter is shifted by j.

A string s over A has k non-overlapping shifted occurrences in t if there exist k non-overlapping sub-strings in t that can be obtained by shifting s. The longest non-overlapping shifted occurrence problem is defined as: given a string t and a positive integer k, find one of the longest sub-strings s of t that has k non-overlapping shifted occurrences in t.

It is desirable to find all maximal sub-strings with multiple occurrences, resulting the {\em non-overlapping shifted re-occurrences problem}: Given a string t, return all maximal sub-strings that have multiple non-overlapping shifted occurrences in t and list of indices of the starting position of each occurrences.

The simple enumeration method solves this problem in $O(n^3)|A|$ time. More efficient algorithm can be obtained with sophisticate data structures. One approach is to modify the suffix trees so that they can express shifted patterns. Another simpler approach is to transform a string t into a difference string t' over integers whose ith letter is the index difference between the i+1st letter and ith letter of t. Simple repetition detection algorithms can then be applied. In both case, the $O(n^2)$ algorithm can be obtained to find all maximal sub-strings that have multiple non-overlapping shifted occurrences in t. Again, in practice, the shifted suffix tree based algorithm can be made to run in time close to linear.

Shifted Repetition with Elongation

The melody and other parts could repeat with elongation, that is, in an repeated recurrence its duration is uniformly elongated or uniformly shortened. To incorporate it into a finite string representation, consider "aabbccddeeffgg" as an elongation of "abcdefg" with a factor of 2.

If s' is an elongation of s with a factor q, then s'=c[s]. For example, "aabbccddeeffgg"=2["abcdefg"]. A string s over A has k non-overlap elongated occurrences in t if there exist k non-overlapping substrings in t that are elongation of s. The notion of shift can be combined with elongation. A string s over A has k non-overlap shifted elongated occurrences in t if there exist k non-overlapping substrings in t that are elongation of shifts of s. These definitions lead naturally to longest non-overlapping shifted and elongated occurrences problem and the non-overlapping shifted and elongated re-occurrence problem. The algorithm for repetition disclosed herein can be extended to solve these two problems.

Repetitions with Small Variations

As discussed previously variation in the repetitions of melody and other music parts could be more sophisticated but not arbitrary. Domain specific music theory can be applied to determine certain variation patterns based on distance metrics between sub-segments in a track. To formally define variations of a segment, a notion of the distance between two strings is needed. A simple and commonly used distance function between two strings s and s' is their Hamming distance H(s, s'), which measures the position-wise difference. Another distance function is the correction distance, C(s,s') which measures the number of basic corrections such as insertion, deletion, and modification that are needed to transform s into s'. In the present invention, two shifted strings are viewed as equivalent strings, if s can be obtained by shifting s', then the distance between s and sis zero. The shifted Hamming distance SH(s,s') and shifted correction distance SC(s,s') can be defined as:

SH, is the smallest Hamming distance between a shift of s and s';

SC, is the smallest correction distance between a shift of s and s'.

In applications such as music summarization, some variations of these distance functions between segments are used based on domain-specific music theory to define plausible repetition patterns.

Let d(s,s') be a distance function between two strings s and s. Let b be a threshold value. A string s over A has k non-overlapping (d,b)-occurrences in t if there exist k non-overlapping substrings in t whose distance to s is no more than b. The longest non-overlapping (d,b)-occurrence problem, given a string t and a positive integer k, is to find a longest sub-string s of t that has k occurrences. The non-overlapping (d,b)-re-occurrences problem, given a string t, is to return all maximal sub-strings that have multiple non-overlapping (d,b) occurrences in t and list of indices of the starting position of each occurrences.

The enumeration method can be extended to solving this general problem in $O(n^4)$ time in the worst case. A graph whose vertices are sub-strings can be built; there are $Q(n^2)$ of them. The edges between two non-overlapping sub-strings has a weight that is equal to the distance between these two sub-strings measured by d. Given a threshold b for each sub-string s, let N(s) be the set of all neighbors in this graph whose distance to s is no more than b. N(s) can be regarded as intervals that are contained in [O:n]. Two neighbors conflict if they overlap. A greedy algorithm can be used to find a maximum independent set of the conflict graph defined over N(s) to find the maximum non-overlapping (d,b) occurrences of s in t. More efficient methods could be developed for certain distance functions d with more advanced data structures.

Thumbnail Generation Process

FIG. 6 is a flowchart illustrating the process steps performed by system 200 as described herein. Specifically, the process begins with step 600 in which an audio file, similar to file 300 of FIG. 3 is converted into a human readable score, similar to notation file 302 of FIG. 3, as illustrated by step 602. Next, the human readable score is converted into a MIDI file format, similar to file 304 of FIG. 3, as illustrated by step 604. Thereafter the MIDI file is provided to a MIDI file analyzer 202, analyzes the MIDI data file 304 to arrange the data in standard track-by-track format, as illustrated by step 606. The results of the MIDI file analyzer 202 are supplied to a primitive component builder 204, as illustrated by step 608, which parses the MIDI file into MIDI primitive data. Thereafter, part component builder 206 detects repetitive patterns within the MIDI data primitives supplied from primitive component builder 204 and builds Parts components therefrom, as illustrated by step 610. In an alternative embodiment of the present invention, part component builder 206 may also generate Part components from a score notation file, such as that of file 302, as illustrated by alternative flow path step 612, thereby skipping steps 606–610. Using the detected parts, the part component builder 206 then generates the summarization hierarchy 210, as illustrated by step 612. The summarization hierarchy is essentially a component tree having at its top a song. The song, in turn, further comprises one or more parts. The parts can sequentially be used to form the song. Each part, in turn, further comprises a number of tracks. Each track, in turn, comprises a number of measures. Each measure, in turn, comprises a number of notes. The melody detector 212 utilizes the algorithms described herein to determine which Part component contains the main melody, as illustrated by step 614. Once the Part containing the main melody has been identified a note or MIDI representation of the main melody is provided to the thumbnail generator 214 by melody detector 212. If the musical piece was provided in MIDI format, the audio thumbnail 216 will be output in MIDI format as well, the MIDI data defining the detected main melody, as illustrated by step 616. If, alternatively, the original input file was an audio file, the audio file is provided to the thumbnail generator 214 and the time stamp data from the MIDI file used to identify the excerpt of the audio file which contains the identified main melody. The resulting audio thumbnail is provided back to the requestor as an audio file.

A software implementation of the above described embodiment(s) may comprise 4 a series of computer instructions either fixed on a tangible medium, such as a computer readable media, e.g. diskette 142, CD-ROM 147, ROM 115, or fixed disk 152 of FIG. 1, or transmittable to a computer system, via a modem or other interface device, such as communications adapter 190 connected to the network 195 over a medium 191. Medium 191 can be either a tangible medium, including but not limited to optical or as analog communications lines, or may be implemented with wireless techniques, including but not limited to microwave, infrared or other transmission techniques. The series of computer instructions embodies all or part of the functionality previously described herein with respect to the invention. Those skilled in the art will appreciate that such computer instructions can be written in a number of programming languages for use with many computer architectures or operating systems. Further, such instructions may be stored using any memory technology, present or future, including, but not limited to, semiconductor, magnetic, optical or other memory devices, or transmitted using any communications technology, present or future, including but not limited to optical, infrared, microwave, or other transmission technologies. It is contemplated that such a computer program product may be distributed as a removable media with accompanying printed or electronic documentation, e.g., shrink wrapped software, preloaded with a computer system, e.g., on system ROM or fixed disk, or distributed from a server or electronic bulletin board over a network, e.g., the Internet or World Wide Web.

Although various exemplary embodiments of the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Further, the methods of the invention may be achieved in either all software implementations, using the appropriate processor instructions, or in hybrid implementations which utilize a combination of hardware logic and software logic to achieve the same results.

What is claimed is:

1. A method of generating an audio summarization of a musical piece having a main melody, the method comprising:

(a) receiving computer-readable data representing the musical piece;

(b) generating from the computer-readable data a plurality of components representing structural elements of the musical piece;

(c) detecting the main melody among the generated components and generating computer-readable data representing the main melody; and (d) generating from the computer-readable data representing the main melody an audio summary containing a representation of the detected main melody.

2. The method of claim wherein step (b) further comprises:

(b.1) creating a hierarchical tree from the generated components, tree representing the hierarchical relationship among the components.

3. The method of claim 1 wherein step (b) further comprises:

(b.1) designating at least some of the components as composite components and others of the components as primitive components, the composite components comprising other components.

4. The method of claim 3 wherein step (c) comprises:

(c.1) detecting the main melody among the primitive components.

5. The method of claim 4 wherein the primitive components represent notes within the musical piece and the composite components represent any of measures, tracks, or parts within the musical piece.

6. The method of claim 5 wherein step (c.1) comprises:

(c.1.1)detecting repetitive patterns of notes within any of the measures, tracks or parts.

7. The method of claim 1 wherein step (a) further comprises the step of:

(a.1) converting an audio wave file representing the musical piece into computer readable data representing the musical piece.

8. The method of claim 1 wherein step (a) comprises:

(a.1) converting a human readable notation representing the musical piece into computer readable data representing the musical piece.

9. The method of claim 1 wherein the computer readable data further comprises data identifying a particular musical genre.

10. The method of claim 4 wherein step (c) further comprises the step of:

(c.1) detecting the main melody in accordance with one or more rules associated with the identified genre.

11. In a computer processing apparatus, an apparatus for generating an audio summarization of a musical piece having a main melody, the apparatus comprising:

(a) an analyzer configured to receive computer-readable data representing the musical piece;

(b) component builder configured to generate from the computer-readable data a plurality of components representing structural elements of the musical piece;

(c) a detection engine configured to detect the main melody among the generated components and generate computer-readable data representing the main melody; and (d) a generator responsive to the computer-readable data representing the main melody and configured to create an audio summary containing a representation of the detected main melody.

12. The apparatus of claim 11 wherein the component builder comprises:

(b.1) program logic configured to create a hierarchical tree from the generated components, tree representing the hierarchical relationship among the components.

13. The apparatus of claim 11 wherein the component builder further comprises:

(b.1) program logic configured to designate at least some of the components as composite components and others of the components as primitive components, the composite components comprising other components.

14. The apparatus of claim 13 wherein the detection engine comprises:

(c.1) program logic configured to detect the main melody among the primitive components.

15. The apparatus of claim 14 wherein the primitive components represent notes within the musical piece and the composite components represent any of measures, tracks, or parts within the musical piece.

16. The apparatus of claim 15 wherein the detection engine further comprises:

(c.1.1) program logic configured to detect repetitive patterns of notes within any of the measures, tracks or parts.

17. The apparatus of claim 11 wherein the analyzer further comprises:

(a.1) program logic configured to convert an audio wave file representing the musical piece into computer readable data representing the musical piece.

18. The apparatus of claim 11 wherein the analyzer further comprises:

(a.1) program logic configured to convert a human readable notation representing the musical piece into computer readable data representing the musical piece.

19. The apparatus of claim 11 wherein the computer readable data further comprises data identifying a particular musical genre.

20. The apparatus of claim 19 wherein the detection engine further comprises:

(c.1) program logic configured to detect the main melody in accordance with one or more rules associated with the identified genre.

21. A computer program product for use with a computer apparatus, the computer program product comprising a computer usable medium having computer usable program code embodied thereon comprising:

(a) analyzer program code configured to receive computer-readable data representing the musical piece;

(b) component builder program code configured to generate from the computer-readable data a plurality of components representing structural elements of the musical piece;

(c) detection engine program code configured to detect the main melody among the generated components and generate computer-readable data representing the main melody; and (d) generator program code responsive to the computer-readable data representing the main melody and configured to create an audio summary containing a representation of the detected main melody.

22. The computer program product of claim 21 wherein the component builder program code comprises:

(b.1) program code configured to create a hierarchical tree from the generated components, tree representing the hierarchical relationship among the components.

23. The computer program product of claim 21 wherein the component builder program code further comprises:

(b.1) program code configured to designate at least some of the components as composite components and others of the components as primitive components, the composite components comprising other components.

24. The computer program product of claim 23 wherein the detection engine program code comprises:

(c.1) program code configured to detect the main melody among the primitive components.

25. The computer program product of claim 24 wherein the primitive components represent notes within the musical piece and the composite components represent any of measures, tracks, or parts within the musical piece.

26. The computer program product of claim 25 wherein the detection engine program code further comprises:

(c.1.1) program code configured to detect repetitive patterns of notes within any of the measures, tracks or parts.

27. The computer program product of claim 21 wherein the analyzer program code further comprises:

(a.1) program code configured to convert an audio wave file representing the musical piece into computer readable data representing the musical piece.

28. The computer program product of claim of 21 wherein the analyzer program code further comprises:

(a.1) program code configured to convert a human readable notation representing the musical piece into computer readable data representing the musical piece.

29. The computer program product of claim 21 wherein the computer readable data further comprises data identifying a particular musical genre.

30. The computer program product of claim 29 wherein the detection engine program code further comprises:

(c.1) program code configured to detect the main melody in accordance with one or more rules associated with the identified genre.

* * * * *